United States Patent [19]

Esner

[11] 4,136,425

[45] Jan. 30, 1979

[54] ANCHORING DEVICES FOR VEHICLE SAFETY BELTS AND HARNESSES

[75] Inventor: Mark E. Esner, London, England

[73] Assignee: Howard Wall Limited, London, England

[21] Appl. No.: 859,750

[22] Filed: Dec. 12, 1977

[30] Foreign Application Priority Data

Dec. 13, 1976 [GB] United Kingdom ..... 51980/76
Jul. 8, 1977 [GB] United Kingdom ..... 28669/77

[51] Int. Cl.[2] ..... A44B 11/25
[52] U.S. Cl. ..... 24/230 A
[58] Field of Search ..... 24/230 A

[56] References Cited

U.S. PATENT DOCUMENTS 3,465,393 9/1969 Fisher ..... 24/230 A
3,895,196 7/1975 Lewis ..... 24/230 A
4,004,115 1/1977 Esner ..... 24/230 A

FOREIGN PATENT DOCUMENTS 106488 4/1965 Norway ..... 24/230 A

*Primary Examiner*—Kenneth J. Dorner
*Attorney, Agent, or Firm*—Shoemaker and Mattare, Ltd.

[57] ABSTRACT

A buckle holds a plate attached to a safety belt by a latch-tooth engaging an aperture or notch. The latch-tooth is pivoted in the walls of a channel and is released by a lever moved by a slot in a slider. The slider slides on flanges on the channel walls. The lever is almost perpendicular to the plane of the path of the slider and when the plate is in the buckle the lever either passes through a slot in the plate and swings on the channel base or swings outside the channel on a rod through the channel walls.

8 Claims, 13 Drawing Figures

ANCHORING DEVICES FOR VEHICLE SAFETY BELTS AND HARNESSES

Figure 1:
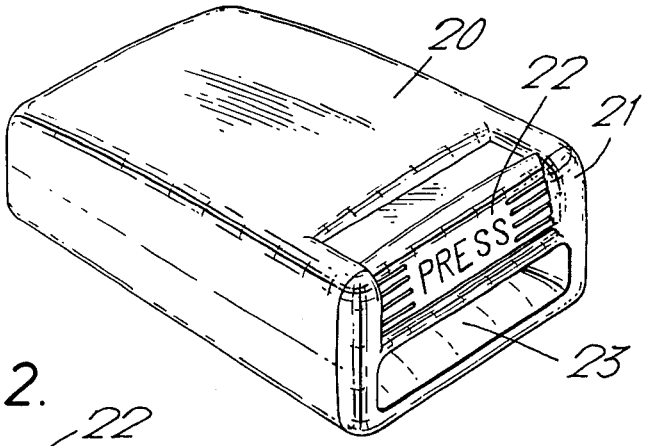

This invention relates to anchoring devices, and particularly to devices for anchoring to the floor, seat or other part of a vehicle or aircraft, a lug or plate attached to a safety belt or harness.

Such a lug or plate, referred to hereinafter as a "plate," is usually provided with one or more apertures, or one or more notches, which is or are engaged by one or more teeth provided in the anchoring device, and with one or more slots to which one or more strap ends can be attached, the strap end or ends forming part of a safety belt or harness.

The anchoring device to which this invention relates, referred to hereinafter as a "buckle," comprises a casing with a mouth into which can be placed that part of the plate carrying the aperture or notches, a latch plate carrying the tooth or teeth which engage the aperture or notches in the plate, a lever or levers which, when operated moves or move the latch plate to release the plate from the buckle, and an element, referred to hereinafter as a "slider," which can be moved manually against the action of a spring to operate the lever or levers to move the latch plate to allow the plate to be ejected from the buckle.

In a known form of such a buckle the latch plate and lever are both pivoted in the walls of a channel and are situated between the slider and the plate when the plate is locked within the buckle, sufficient space being provided between the slider and the plate to accommodate the lever and the latch plate and to allow the lever to swing sufficiently to move the latch plate far enough to lift the tooth or teeth from the aperture or notches in the plate. To keep the buckle slim, the lever is operated by a cam slope on the slider and is placed in the buckle so that it makes an angle of about 60 degrees to the path of the slider. The pressure of the latch spring on the latch plate is communicated to the slider through the lever, and, unless the lever is at right angles to the plane of the path of the slider, a component of the pressure from the latch spring increases the friction between the slider and the edges of the channel on which the slider moves and the friction between the end of the lever and the cam slope on the slider against which the end of the lever rides, increasing the effort required to move the slider to release the plate from the buckle. Similar, but much heavier, back pressure takes place from the latch through the lever when the plate is under heavy load, for example after an accident when the wearer is slumped across the belt.

The object of the invention is to produce a slim buckle which retains the advantages of the pivoted lever and latch plate whilst reducing the effort required to move the slider into the release position.

Another object of the invention is to provide a buckle which can be attached to a vehicle through a bracket or cable or by means of a strap end as desired.

According to this invention a buckle for holding a plate having an aperture or a notch and means by which it can be attached to a vehicle safety belt or harness comprises a casing, a latch plate, a slider and a lever in which the casing has a mouth into which can be placed that part of the plate which carries the aperture or notch, the latch plate is pivoted within the casing and carries a tooth which engages the aperture or notch, the slider can be slid along a path parallel to that taken by the plate end as it is slid into the buckle to operate the lever to swing the latch plate to move the tooth out of the aperture or notch and the lever is positioned in the buckle so that when the plate is locked within the buckle the surface of the plate nearer the slider is nearer to the slider than the end of the lever remote from the slider.

The buckle can include a channel and the lever can be hook shaped and can swing on or with a rod mounted in the walls of the channel or in a groove in the base of the channel.

The lever can pass through a slot in the plate when the plate is locked within the buckle and the hooked end of the lever can act directly on the tooth of the latch plate.

The buckle can have two levers which can be mounted on a rod carried in holes in the walls of the channel and the levers can be outside the walls of the channel and engage arms on the latch plate which arms pass through apertures in the walls of the channel.

A spring can be provided to hold the latch plate in locking position, the spring also holding the latch plate against its fulcrum in the walls of the channel and holding the rod carrying the levers against movement.

Cam slots can be provided in the slider to engage the lever or levers and back stops can be provided to prevent excessive movement of the levers. The lever or levers can be mounted within the buckle so that the lever or levers is or are at right angles to the plane of the path of the slider at some stage during the movement of the slider.

Figure 2:
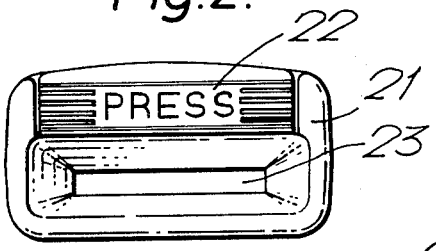
Figure 4:
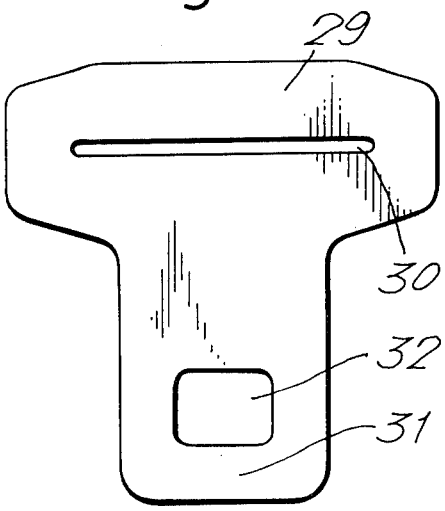
Figure 5:
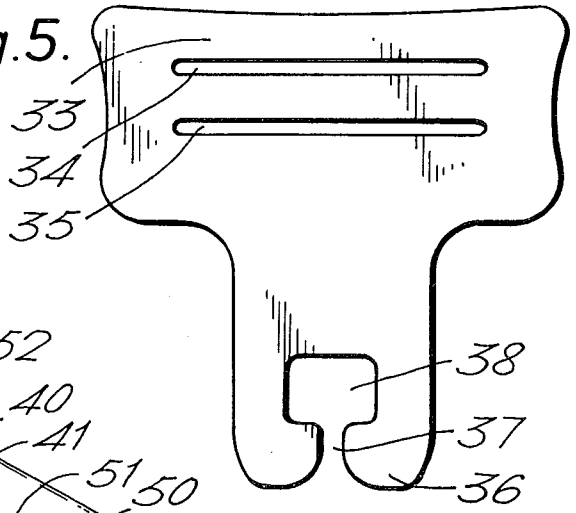
Figure 6:
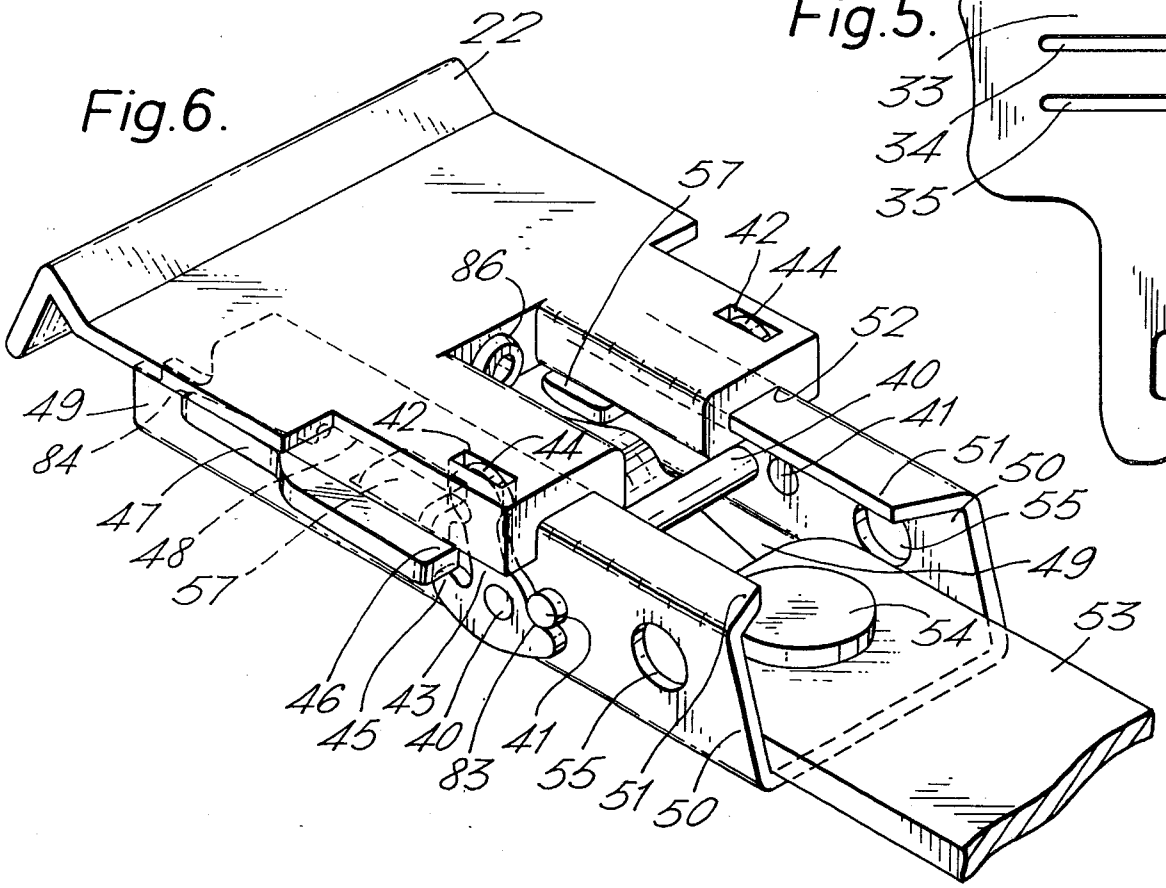
Figure 7:
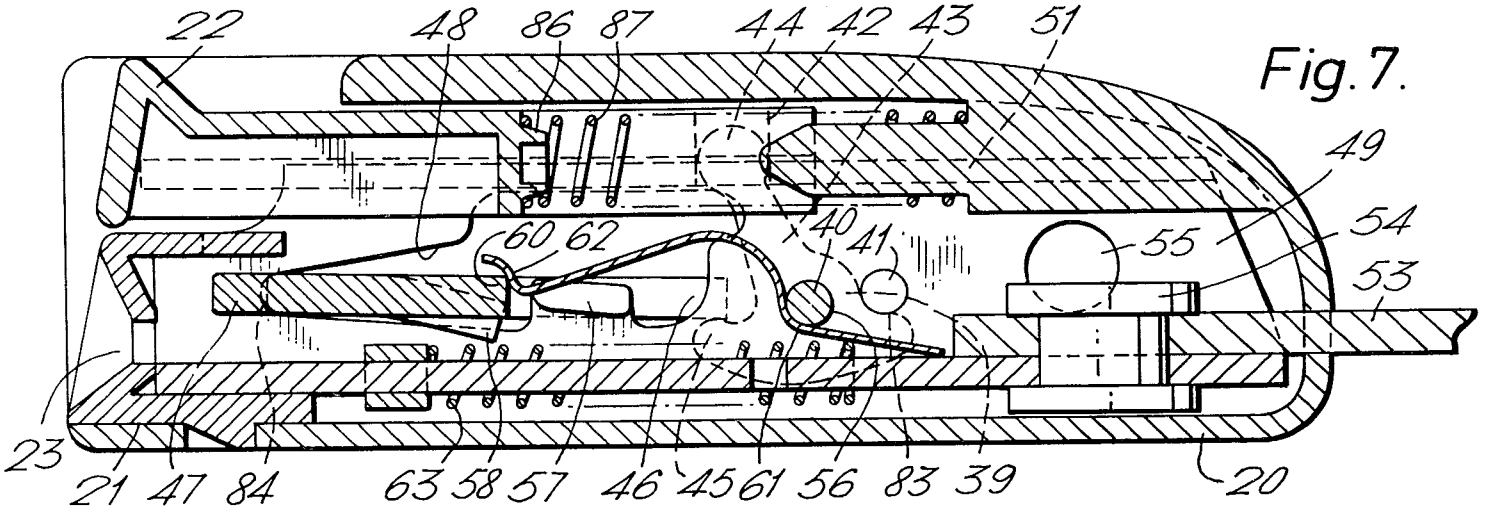
Figure 9:
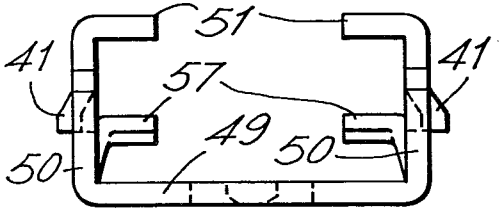
Figure 8:
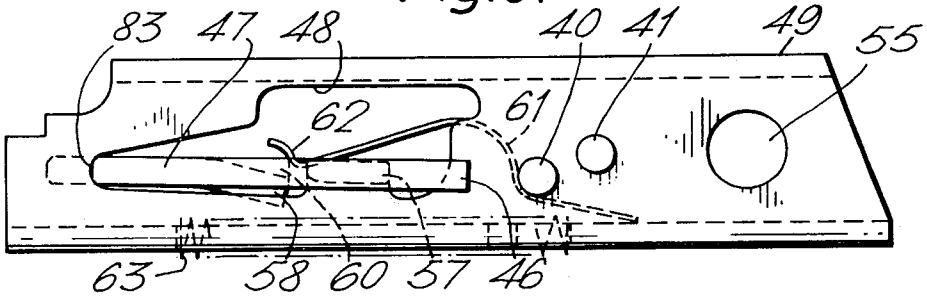
Figure 11:
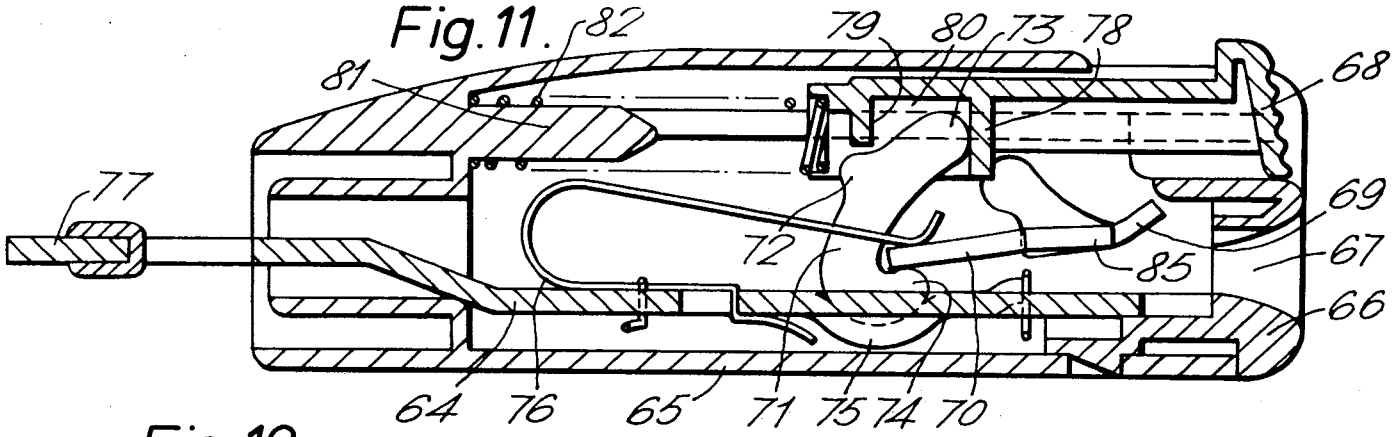
Figure 13:
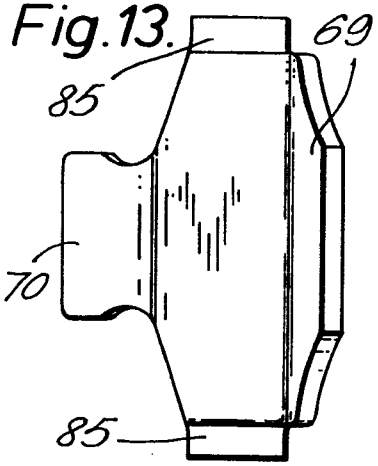
Figure 12:
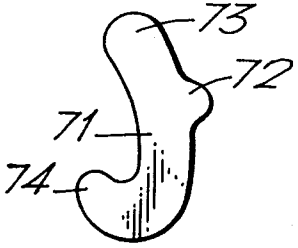
Figure 10:
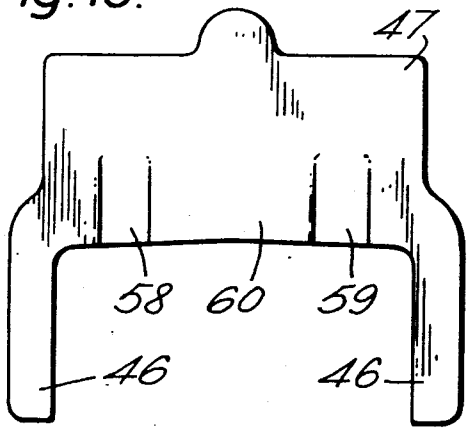

The invention is described hereinafter with reference to the accompanying drawings of which FIG. 1 is an outside view of a buckle according to the invention, FIG. 2 is an end view of the buckle shown in FIG. 1, FIGS. 3, 4 and 5 show three different forms of plate which can be used with the buckle according to the invention, FIG. 6 is a view of part of the buckle shown in FIGS. 1 and 2 with part of the casing removed to show the operation of the levers, FIG. 7 is a section of the buckle shown in FIG. 6, FIG. 8 is a view of the channel used in FIG. 6 with the latch plate and latch spring in position, FIG. 9 is an end view of the channel shown in FIG. 8, FIG. 10 is a plan view of the latch plate shown in FIG. 8, FIG. 11 is a sectional view of a buckle according to the invention using a single lever pivoted in the base of the channel, FIG. 12 is a view of the lever shown in FIG. 11 and FIG. 13 is a view of the latch plate shown in FIG. 11.

The buckle shown in FIGS. 1, 2, 6, 7, 8, 9 and 10 comprises an outer casing 20, a lipsection 21 which includes the mouth 23, a slider 22 which slides on flanges 51 of channel 49, a latch plate 47 and levers 39.

Figure 3:
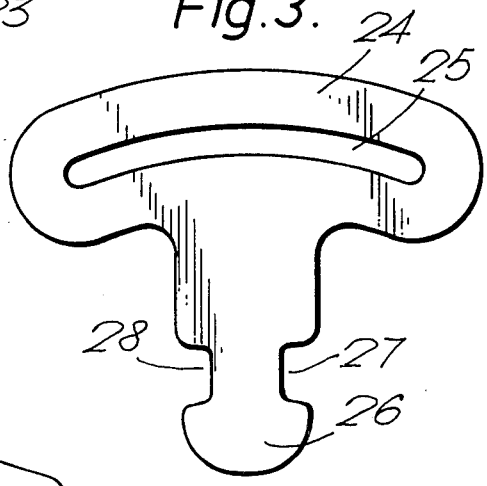

This buckle as shown is for use with a spade ended plate 24, FIG. 3, the buckle having two latch teeth 58 and 59 which engage notches 27 and 28 in the edges of plate 24. The plate has a slot 25 to which the webbing of a seat belt or harness can be attached by sewing or any other suitable means.

Latch plate 47 has teeth 58 and 59 and arms 46 which embrace walls 50 of channel 49 and are engaged by ends 45 of levers 39. Latch plate 47 pivots in the ends 84 of apertures 48 in walls 50 of channel 49, the latch plate being pressed against the ends 84 of the apertures by the bent-up end 62 of latch spring 61, which end 62 bears on the portion 60 of latch plate 47, spring 61 also presses against pivot rod 40 which is carried in holes in the walls 50 of channel 49. Latch plate 47 is positioned in channel 49 by lugs 57, the lugs also preventing the plate 24 rising with the latch teeth when the plate is being released from the buckle. The lugs can be shaped to position the end 26 of plate 24 centrally in channel 49.

Levers 39 are mounted on the ends of rod 40 and swing on or with the rod. The levers have holes 56 to fit the rod 40, hooked ends 45 which engage arms 46 of latch plate 47 and arms 43 having ends 44 which enter cam slots 42 in slider 22. The edge of each lever 39 opposite hook 45 is shaped as at 83 to engage backstops 41 on the walls 50 of channel 49. The levers 39 are prevented from slipping from the rods 40 by ribs, not shown, on the inner walls of casing 20. The rod 40 is held in position by pressure from the latch spring 61 as mentioned above.

Channel 49 can be attached to the structure of a vehicle or aircraft by a strop 53 connected to the base of the channel by rivet 54, or by a strap end fixed to a rod, not shown, which passes through holes 55 in channel walls 50.

An ejection spring 63, FIG. 8, rides on a spigot in the base of the channel to eject the plate from the buckle when the latch teeth are released.

Slider 22 is pressed into the position shown in FIGS. 1, 6 and 7 where the front of the slider forms part of the casing of the buckle by spring 87 assisted by latch spring 61. The slider 22 has grooves 52 which hold the slider on the flanges 51 of walls 50 of channel 49 and cam slots 42 with vertical faces which are engaged by ends 44 of levers 39, the ends of the levers being rounded to reduce friction between the levers and the faces of the cam slots. The cam slots are positioned so that the lever arms 43 are almost vertical to the plane of the path of the slider when the slider is in the position shown in the figures and so that the lever arms pass through the vertical position as the slider is moved along the flanges 51. This positioning gives minimum vertical movement of the ends 44 of the lever arms in the cam slots and maximum transfer of energy from the reciprocating motion of the slider to the rotary motion of the levers.

In operation, end 26 of plate 24 is pressed into mouth 23 of the buckle. The end of the plate lifts the latch teeth 58, 59 against the action of spring 61, lugs 57 guide the end 26 into the centre of the channel and the latch teeth 58, 59 drop into the notches 27, 28 in the sides of plate 24 to lock the plate within the buckle. When plate 24 is so locked in the buckle the parts of the levers farthest from the slider are farther from the slider than the face of the plate 24 nearer the slider. To release the plate from the buckle, the slider 22 is pressed into the buckle casing, the slider sliding on the flanges 51 of the slider walls 50, the vertical faces of the cam slots 42 move the ends 44 of levers 39 so that the levers swing on or with rod 40. The hooked ends 45 of the levers move the latch plate 47 about its fulcrum 84 in apertures 48 to lift the latch teeth 58, 59 from notches 27, 28 in the sides of plate 24. Plate 24 is prevented from moving with the latch teeth by lugs 57. When the teeth 58, 59 are clear of notches 27, 28, the plate 24 is ejected from the mouth of the buckle by ejection spring 63. When pressure is removed from the end of the slider 22, the slider is returned to its normal position by the combined action of springs 87 and 61, spring 61 pressing the latch plate back into its locking position and in doing so exerting pressure on hooked ends 44 of levers 39 to return the levers to the positions shown in the figures and to assist the return of the slider to its normal position.

The buckle as described above is for use with a spade ended plate as shown in FIG. 3. By replacing the latch plate 47 by a plate having a single central tooth, the buckle can be used with plates having an aperture as shown in FIGS. 4 and 5, the single tooth engaging the aperture 32 in end 31 of plate 29, FIG. 4, or aperture 38 in end 36 of plate 33, FIG. 5.

The buckle is described above as having two levers, but one lever only need be provided, the lever being placed on the right hand or left hand side of the channel as desired, or the lever or levers could be accommodated within the channel walls, the plate end passing beside the end of the lever or levers as it is pressed into the buckle.

The buckle has the advantage of vertical levers and slimness but is wider than would be necessary if a single central lever were used, the plate shown in FIG. 5 being used and the lever end passing through the slot 37 in the end of the plate. With this arrangement it is possible to dispense with the rod 40, the lever being arranged to pivot in a depression in the channel base.

An embodiment of the invention with this arrangement is shown in FIG. 11.

The buckle has a casing 65, a slider 68, a channel 64, a latch plate 69 and a lever 71. Lever 71 has a hooked end 74, an end 75 which engages the vertical wall of cam slot 80 in slider 68 and a backstop projection 72 which engages the edge of wall 79 on slider 68. The lever swings in a depression 75 formed in the base of channel 64.

Channel 64 is provided with a tail 77 which can be fixed in any suitable manner to a vehicle, and with slots in its walls to accommodate pivots 85 of latch plate 69.

Latch plate 69 is provided with a single tooth 70 which engages aperture 38 in plate 33. A latch spring 76 presses the latch tooth 70 into its locking position. The tooth 70 rests on the hooked end 74 of lever 71, which lever is made of such a thickness as to pass easily through slot 37 in plate 33. An ejection spring, not shown, is provided on a spigot in the base of the channel, similar to the ejection spring 63 described above.

Slider 68 runs on flanges of the walls of channel 64. Spring 82 held on spigot 81 on casing 65 and a spigot on the slider presses the slider into the position shown in FIG. 11 where the front of the slider forms part of the casing of the buckle. The slider is provided with a cam slot 80 whose vertical walls 78, 79 engage the end of the lever 71.

In operation, the end 36 of plate 33 is pressed into the mouth 67 of lip section 66 of the casing of the buckle, the end 36 lifting the tooth 70 of latch plate 69 against the pressure of spring 76, the hooked end 74 of lever 71 enters the slot 37 in the end 36 of plate 33 and the tooth 70 drops into aperture 38 in plate 33 to lock the plate within the buckle. To release the plate, the slider 68 is slid into the buckle, wall 78 of cam slot 80 presses against the end 73 of lever 71 to swing the lever in depression 75.

The hooked end 74 of the lever 71 lifts tooth 70 from the aperture 38 in plate 33, lugs in the channel walls preventing the plate moving with the latch tooth. When the tooth 70 is clear of the aperture 38, the ejection spring ejects the plate from the mouth 67 of the buckle. When pressure is removed from the slider 68, the latch lever and slider are returned to the positions shown in FIG. 11 by the combined action of springs 76 and 82.

In either of the embodiments described above electrical contact means can be provided within the buckle controlled either by the end of the plate or by the ejection spring to operate means to indicate when the plate is or is not locked within the buckle or to prevent movement of the vehicle to which the buckle is attached until the plate has been locked within the buckle.

Plate 29 has a slot 30 which a strap end of a safety belt or harness can be attached whilst plate 33 has two slots 34, 35 for strap ends of a safety belt or harness. These slots are shown as parallel to each other and to the edge of the plate but they could be arranged at any desired angle to each other and to the edge of the plate. Snubbers can be fitted to the plates and the safety belt or harness can be connected to retracting reels as desired.

The invention is not restricted to the particular embodiments described above.

I claim:

1. A buckle mechanism comprising:

a locking plate having a face, a forward end and an opening defined therein and means connected to a rear end thereof for attaching said plate to a vehicle;

a buckle means having a hollow casing, said casing having a top, bottom, sides and ends with a mouth being defined in one of said ends for receiving said locking plate;

means for attaching said buckle means to a vehicle;

channel defining means defining a channel in said casing, said channel having a base and a longitudinal axis;

flanges mounted on said casing in said channel;

a slider slidably mounted on said flanges and having an end located adjacent said casing mouth, said locking plate having a face presented toward said slider when said locking plate is received in said casing;

a latch plate pivotally mounted at one end thereof in said channel and including an arm on another end to be located remote from said one end, said arm extending forwardly and away from said latch plate, and a tooth positioned between and separating said latch plate arm and said one end to engage said locking plate opening when said locking plate is received in said casing;

a double ended lever swingably mounted on said casing to move along a path having a portion thereof oriented at right angles to said channel longitudinal axis;

one end of said lever contacting said slider directly and another end of said lever contacting said latch plate arm directly and being located farther from said slider than said locking plate face thereby locating said locking plate between said lever another end and said slider so that said latch plate arm is lifted by said lever another end upon actuation of said slider to lift said latch plate tooth out of engagement with said locking plate opening when said locking plate is received in said casing; and an ejection spring mounted in said casing and engaging said locking plate forward end when said locking plate is received in said casing for ejecting said locking plate from said casing when said latch plate tooth is disengaged from said locking plate opening.

2. A buckle as in claim 1 further including a groove defined in said channel base with said lever pivoted in said groove.

3. A buckle as in claim 1 wherein said channel defining means has walls and further including holes defined in said channel walls and a rod carried by said holes, said lever being pivotally connected to said rod.

4. A buckle mechanism comprising:

means for attaching the buckle to a vehicle;

a locking plate having notches defined in the sides thereof, said locking plate having a face;

means for attaching said locking plate to a vehicle;

a buckle means having a hollow casing, said casing having a top, bottom, sides and ends with a mouth defined in one end for receiving said locking plate;

channel defining means defining a channel in said casing, said channel having walls and a top, said walls having apertures defined therein;

flanges on said channel walls;

a slider slidably mounted on said flanges, said slider having slots defined therein and a first end located adjacent said casing mouth, said locking plate having a face presented toward said slider when said locking plate is received in said casing;

first spring means attached to said casing and contacting said slider to hold said slider in a position in which said slider first end forms part of said casing mouth;

a latch plate mounted on said casing to swing in said wall apertures, said latch plate having two teeth which engage said locking plate notches to lock said locking plate into said casing and arms which extend outwardly from said latch plate beyond said channel walls;

a rod mounted in said wall apertures;

two levers mounted on the ends of said rod and each having a hooked end which engages said latch plate arms;

a second spring means mounted in said casing to bear on said latch plate for urging said latch plate into a locking position and for maintaining an edge of said latch plate pressed against corners in said apertures and for limiting movement of said levers;

said levers each having another end slidably received in said slider slots to be moved by said slider when said slider is moved, said levers having another end located farther from said slider than said locking plate face when said locking plate is received in said casing.

5. A buckle as in claim 4 wherein said channel has a longitudinal axis and each lever is swingably mounted on said casing to move along a path having a portion thereof oriented at right angles to said channel longitudinal axis.

6. A buckle as in claim 5 further including a third spring mounted on said casing for ejecting said locking plate from said casing when said teeth are disengaged from said locking plate notches.

7. A buckle mechanism comprising:

a locking plate having an aperture and a slot defined therein;

means for attaching said plate to a vehicle;

a buckle means having a hollow casing, said casing having a top, bottom, sides and ends with a mouth defined in one end for receiving said locking plate;

channel defining means defining a channel in said casing, said channel defining means having walls, a base and a top, said channel walls having apertures defined therein and said base having a groove defined therein;

flanges on said channel walls;

a slider slidably mounted on said flanges and having a first end located adjacent said casing mouth, said slider having a slot defined therein;

first spring means mounted on said casing and engaging said slider to hold said slider;

a latch plate having pivot means engaging said channel wall apertures and a tooth for engaging said locking plate aperture to lock said locking plate in said casing;

a lever mounted on said casing to pivot in said channel base groove, said lever passing into said locking plate slot and having a hooked end engaging said latch plate tooth; and a second spring means mounted on said casing and engaging said latch plate for holding said tooth in a locking position.

8. A buckle as in claim 7 further including a third spring means on said casing for ejecting said locking plate from said casing when said tooth is disengaged from said locking plate aperture.

* * * * *